United States Patent [19]

Haberstock

[11] Patent Number: 5,007,278

[45] Date of Patent: Apr. 16, 1991

[54] DIE DEVICE

[76] Inventor: Rolf Haberstock, Rheinhöhe 14, Küssaberg, Fed. Rep. of Germany, D-7897

[21] Appl. No.: 465,385

[22] Filed: Jan. 16, 1990

[30] Foreign Application Priority Data

Jan. 18, 1989 [CH] Switzerland ..... 154/89

[51] Int. Cl.[5] ..... B21D 5/02

[52] U.S. Cl. ..... 72/383; 72/389; 72/449; 72/482

[58] Field of Search ..... 2/389, 413, 414, 383, 2/387, 212, 213, 473, 702, 449

[56] References Cited

U.S. PATENT DOCUMENTS

| | | | |
|---|---|---|---|
| 2,343,082 | 2/1944 | Proctor | 72/213 |
| 2,401,652 | 6/1946 | Mizrach | 72/449 |
| 3,306,093 | 2/1967 | Sassak | 72/389 |
| 3,834,206 | 9/1974 | Lamontagne | 72/458 |
| 4,640,113 | 2/1987 | Dieperink et al. | 72/389 |

FOREIGN PATENT DOCUMENTS

| | | | |
|---|---|---|---|
| 0401840 | 9/1924 | Fed. Rep. of Germany | 72/213 |
| 8234901 | 4/1983 | Fed. Rep. of Germany . | |
| 1221933 | 6/1960 | France | 72/389 |
| 0036923 | 2/1988 | Japan | 72/389 |
| 0199028 | 8/1988 | Japan | 72/383 |
| 0351828 | 3/1961 | Switzerland | 72/213 |
| 0576141 | 10/1977 | U.S.S.R. | 72/389 |
| 1278064 | 12/1986 | U.S.S.R. | 72/389 |

OTHER PUBLICATIONS

"One Di-Acro Rol-Form Die", Di-Acro, 1958, 4 pages.

*Primary Examiner*—David Jones
*Attorney, Agent, or Firm*—Poms, Smith, Lande & Rose

[57] ABSTRACT

This invention relates to a die device for the die bending of metal plates (sheet), with two shafts (4, 5), supported rotatable around their lengthwise axis, flattened on one side, and arranged side by side, parallel lengthwise. In particular, in order to be able to produce even bending legs with a length less than the radius of the shaft, in the die device according to the invention, the rotation of the shafts in opposite directions is force-coupled by coupling mechanism (6–10).

21 Claims, 3 Drawing Sheets

DIE DEVICE

FIELD OF INVENTION

The present invention relates to a die device having two die bars which are rotatable around their lengthwise axis and are arranged contiguously, side-by-side for use in bending flat metal stock, such as sheet metal and the like. Such die device are for use in conjunction with a bending punch in the ram of a power brake or the like for bending such flat stock. More particularly, the present invention relates to a die device wherein the die bars are force-coupled by coupling means to require synchronous rotation of the die bars, thereby making it possible to produce angularly bent stock with leg lengths shorter than the radius of the die bar.

BACKGROUND

Die devices having rotatable die bars are well known. These devices are comprised of a body member having a flat and horizontally oriented upper surface. A pair of elongated die bars typically are mounted in or on the body in a contiguous side-by-side manner engaging each other at a position which is aligned with the direction of the bending punch. The die bars have flat upper surfaces which lie in a common plane and in alignment with the flat upper surface of the body member.

This flat upper surface of the body member and the die bars provide a flat contact surface for the metal stock which is to be bent. When the bending stamp or punch is moved or driven against the metal stock in the area along the contiguous edges of the die bars, the die bars rotate to form a V-shaped groove and cause the metal stock to be bent to the desired angle.

One of the advantages of a die device with rotatable die bars is that it bends the metal stock without damaging or marking it. In contrast, die devices which utilize fixed V-shaped female dies have the disadvantage of producing distinctively perceptable and objectionable marks on the metal stock along the bend in the area at which the metal stock engages the die when the bending punch is driven into the die to produce the bend.

Die devices having rotatable die bars, rather than V-shaped dies are not, however, without limitations. For example, in the known die devices which have rotatable die bars, the edge of the metal stock to be bent must reach beyond the line along the center of the flat upper surface of each die bar (i.e., beyond the line parallel to the axis of rotation of each die bar). In the known die devices, each die bar rotates freely and independently of the other. Where a punch is moved or driven against a piece of metal stock, one end of which does not reach beyond the center of the flat upper surface of one of the die bars, that die bar will be permitted to turn away freely. As a result, the metal stock is either not bent at all, or not bent to the desired angle.

This requirement has proven to be a considerable limitation in the use of these types of die devices because it is often necessary (especially to attain greater rigidity) to produce bent metal stock in which the leg lengths are shorter than the radius of the die bars.

SUMMARY OF INVENTION

It is an object of this invention to overcome the limitation set forth above in the known die devices having rotatable die bars wherein it is not possible to effect a bend in metal stock where both edges of the metal stock do not reach beyond the line along the middle of the flat upper surface of one or both of the die bars and it is not possible to produce bent stock with one or more leg lengths which are shorter than the radius of the die bars. This objective is achieved through the use of coupling means to force-couple the rotation of the die bars. The coupling means causes synchronous rotation in opposite directions of the die bars and limits and controls their angle of rotation. As a result, where a piece of metal stock does not lie sufficiently beyond the line along the middle of the flat upper surface of one of the die bars (i.e., beyond the line parallel to the axis of rotation of the die bar) the coupling means prohibits the die bar to turn away freely. Rather, the die bar is forced to rotate to the desired angle. This angle is determined by the contact of the other leg of the bend against the flat upper contact surface of the other die bar.

Means may also be provided for the production of a moment of rotation which acts on both die bars during the bending process, and, after the bending process, returns the die bars to their original position. Through said means, which may be a spring, for example, the bending process is improved considerably.

BRIEF DESCRIPTION OF THE DRAWINGS

The invention is explained in more detail below with reference to the drawings, in which.

DESCRIPTION OF PREFERRED EMBODIMENTS

Figure 1:
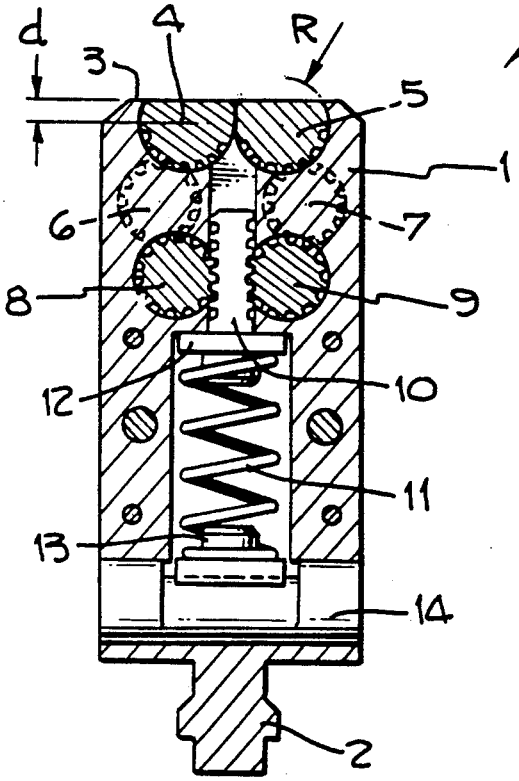
FIG. 1 is a detailed section view of a die device according to the invention.

The die device shown in FIG. 1 has a base body 1, with an approximately square upper part, and a base part 2. The base part 2 is designed to be suitable for fastening to a bending machine, such as in the ram of a power brake or the like. The ends of the upper part of the base body 1 may be covered by cover plates which may be secured to the base body 1 by any suitable means, for example, by screws. The upper surface 3 of base body 1 is flat, and formed therein are two cylindrical cradles which hold and support two die bars 4 and 5. The die bars 4 and 5 extend over the entire length of the base body 1 and are rotatable and arranged in a contiguous side-by-side manner. The upper surfaces of the die bars 4 and 5 are flat. These flat upper surfaces lie in a common plane and in alignment with the flat upper surface 3 of base body 1, as shown in FIG. 1. The cylindrical lower surfaces of die bars 4 and 5 (i.e., that portion of the surface area of die-bars 4 and 5 which is not flat) extends over an angle of more than 180°. The die bars 4 and 5 are, therefore, securely embedded in the base body 1 to prevent them from being jarred out or falling out during the operation of the die device or at other times. The radius R of the die bars 4 and 5 is equal and in each case about twice the said distance d, which is the distance between the upper surfaces 4 and 5 and the axis. The length of the distance d and radius R is dependent upon the thickness D (FIG. 3) of the metal stock to be bent. In the preferred embodiment, $D+d<R$.

The cylindrical lower surfaces of die bars 4 and 5 are formed with teeth in the manner of a cogwheel. Through these teeth, the die bars 4 and 5 are engaged, in each case, with at least one cogged disk 6 and 7, as shown in FIG. 1. In the preferred embodiment, however, each die bar 4 and 5 is engaged by a cogged disk and a cogwheel shaft, arranged one after the other in a lengthwise direction. This preferred embodiment is shown in FIG. 1, wherein die bar 4 is engaged by cogged disk 6 and cogwheel shaft 8, while die bar 5 is engaged by cogged disk 7 and cogwheel shaft 9. The length or thickness of cogged disks 6 and 7 is about ¼ of the length of base body 1. The length of at least one of cogwheel shafts 8 and 9, like die bars 4 and 5, extends over the entire length of base body 1. The cogwheel shafts 8 and 9 are engaged, in turn, by a toothed coupling rack 10, which is arranged in a vertical position between cogwheel shafts 8 and 9 and is movable lengthwise in a plane perpendicular to the common plane formed by the alignment of the flat upper surface 3 of base body 1 and the flat upper surfaces of die bars 4 and 5. The toothed coupling rack 10 has teeth formed on both sides along its entire length. These teeth engage the teeth on cogwheel shafts 8 and 9. Like the cogged disk 6 and 7, the length or thickness of the toothed coupling rack 10 is only about ¼ of the length of base body 1. In the preferred embodiment the toothed rack 10 is arranged in the base body 1, about midway of its length. It may, however, as will be explained below, also be arranged against one of the two end surfaces of base body 1.

The movement of the toothed coupling rack 10 in its lengthwise direction is further controlled by a pressure spring 11, into which end pieces 12 and 13 are set at each end. All of said elements, that is, the cogged disks 6 and 7, the cogwheel shafts 8 and 9, the toothed coupling rack 10, as well as the pressure spring 11 by its end pieces 12 and 13 are, like die bars 4 and 5, embedded in the openings in base body 1. In the case of cogged disks 6 and 7, there are sack holes (holes which do not pass through base body 1), in the case of cogwheel racks 8 and 9, passage holes and in the case of the toothed coupling rack 10 and the pressure spring 11, rectangular or cylindrical openings. Said openings are partly connected with each other to facilitate the mutual engagement of the elements supported in them, as described above. The maximum length of the pressure spring 11, together with end pieces 12 and 13, which are set in the ends thereof, is determined by the length of the opening provided for it in the base body 1. The pressure spring 11 must, of course, have a sufficient amount of tension to remain stationary in the opening and exert the desire force. The lower or bottom end piece 13 of pressure spring 11 lies against an cam 14. By rotating the cam 14, the prestress of the pressure spring 11 can be varied within certain limits.

FIG. 1 shows the pressure spring 11 in its maximum expanded position with toothed coupling rack 10 pushed into its farthest upward position. In this position, die bars 4 and 5 are so directed in their rotary position that their flat upper surfaces align and form a common flat plane with the flat upper surface 3 of the base body 1.

In the die device described above, the two die bars 4 and 5 are force-coupled with respect to their rotation. As a result, they can only turn synchronously and in opposite directions. From their positions shown in FIG. 1, die bar 4 can turn only clockwise, while die bar 5 can turn only counterclockwise. As die bars 4 and 5 rotate clockwise and counterclockwise, respectively, cogged disks 6 and 7 are caused to move counterclockwise and clockwise, respectively. This, in turn, causes cogwheel shafts 8 and 9 to rotate clockwise and counterclockwise, respectively, or, in the same directions as die bars 4 and 5. As the cogwheel shafts 8 and 9 rotate clockwise and counterclockwise, respectively, the toothed coupling rack 10 is moved in a downward position toward the end piece 13 and the cam 14. As the toothed coupling rack 10 is moved downward, the pressure spring 11 is compressed. The force, or moment of rotation effect, necessary to overcome the spring effect is applied in the bending process by driving the bending punch into the die device. Before and after the bending process, the moving elements of the die device are held in place under the pressure of the pressure spring 11, in the position shown in FIG. 1.

Figure 2:
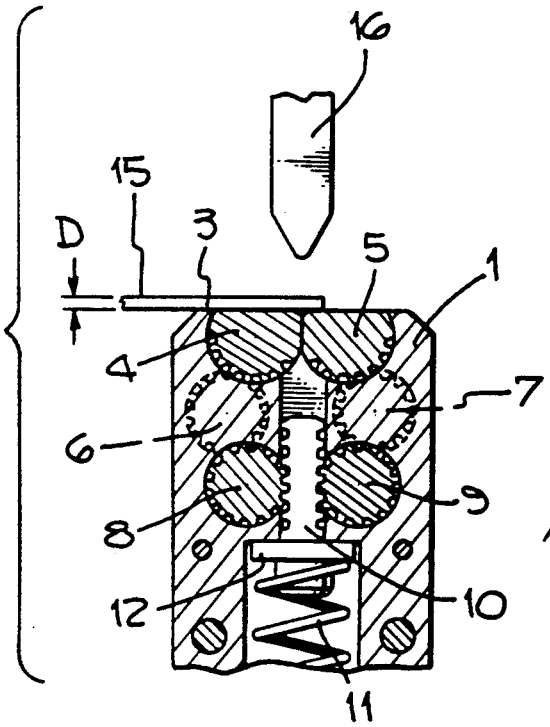
FIG. 2 is a detailed section view of a die device similar to FIG. 1 and showing the die device in a shifted condition wherein the bending punch has engaged the metal stock causing a bend therein and causing a rotation of the die bars.

FIG. 2 shows die bars 4 and 5 in a position, rotated opposite each other. The flat upper surface of die bars 4 and 5 form an angle less than 180°. Preferably, the die device is so designed that a relative angle between the flat upper surfaces of die bars 4 and 5 of up to about 60° is possible. In the rotated position shown in FIG. 2, the toothed coupling rack 10 has been moved downward toward end piece 13 and cam 14 and the pressure spring 11 is compressed tightly.

Figure 3:
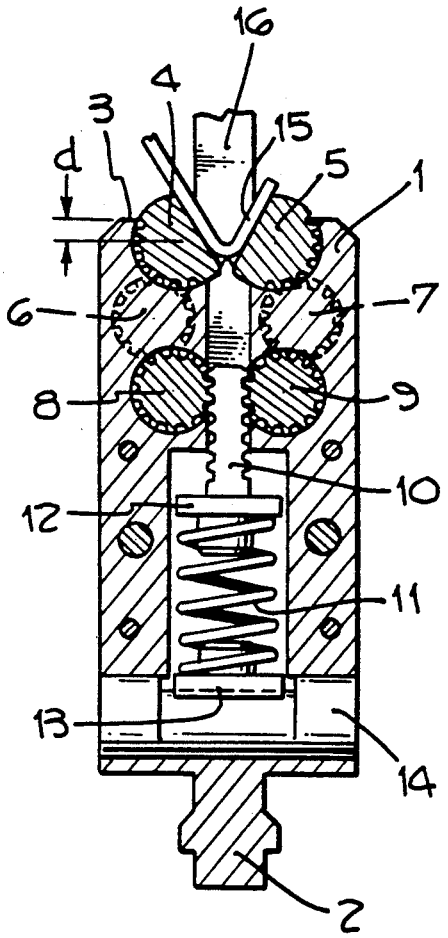
FIG. 3 is a detailed section view of the upper portion of the die device shown in FIG. 1 and also shows the position of a typical bending punch and a piece of flat metal stock which does not extend beyond the axis of rotation of one of the die bars.

FIG. 3 shows only the upper part of the die device shown in FIG. 1. In addition, however, FIG. 3 shows a piece of metal stock 15 and the tip of bending punch 16. In FIG. 3, the flat metal stock 15 does not reach beyond the line along the middle of the flat upper surface of die bar 5 (i.e., the line parallel to the axis of rotation of die bar 5). Still, it is possible to bend metal stock 15 to the desired angle, even if placed on the die device according to FIG. 3. Because die bars 4 and 5 are force-coupled, die bar 5 cannot simply turn away freely in a counterclockwise manner. Rather, it is forced, as a result of the force-coupling, to be set into a rotary position which is determined by die bar 4. The rotary position of die bar 4, in each case, comes to a somewhat tangential position with the stock which is to be bent.

For the operation described above, the pressure spring 11 is not necessary, per se. However, a considerably improved bending process is attained by the effect of the pressure spring 11. The bending surface is flatter. The beveled edge of the metal stock within the zone of curvature falls nearly on top of the ideal line in the middle of the flat metal stock. In cutting the stock, only a very slight correction factor need be taken into account. Moreover, the tolerance for the lengths of the bending legs of the stock are far superior to any values attainable up to now.

The pressure spring 11 effects a moment of rotation on the die bars 4 and 5 which is directed opposite the moment of rotation exerted on them by the bending punch 16 during the bending process. To deform or bend the metal stock, therefore, the moment of rotation caused by the pressure of the bending punch 16 must, in each phase of the bending process, exceed the moment of rotation caused by the pressure spring 11. That is, the pressure exerted against the flat metal stock 15 by the bending punch 16 must be greater than the pressure exerted on the die bars 4 and 5 by the pressure spring 11 in order to attain the desired bend. When the strength of the pressure spring 11 is selected properly, based on the thickness and physical characteristics of the flat metal stock, it provides a very flat bending surface, as discussed above. During the bending process the stock bends in an ideal way into its predetermined form. Moreover, the stock always lies flat against the flat upper surfaces of die bars 4 and 5, especially during the initial phase of the bending process.

The die device according to the present invention may be developed further so that it can be assembled from base elements arranged one after the other in a series, and also, of intermediate or extension (lengthening) elements. The extension elements make it possible to easily adapt the length of the die device, by adding or removing extension elements, to the length of the flat metal stock to be bent.

Figure 4:
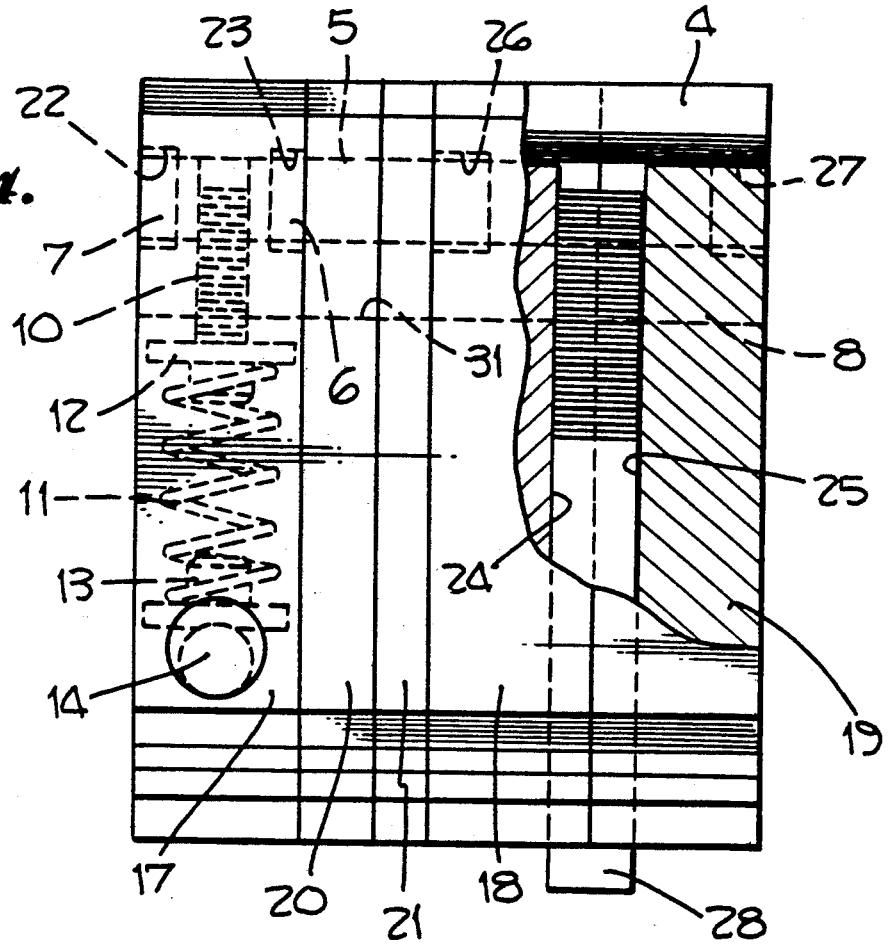
FIG. 4 is a partial longitudinal section showing part of a die device assembled from several elements.

FIG. 4 shows, in a longitudinal sectional view, a portion of the body of such a die device It is comprised of three base elements 17, 18 and 19, as well as two extension elements 20 and 21. Base element 17 corresponds exactly to the die device represented in FIGS. 1, 2 and 3 (i.e., a die device with four toothed disks which engage the die bars, two cogged disks and two cogwheel racks). Two of the openings receiving the toothed disks are represented in broken lines, and marked 22 and 23, respectively. Also indicated in broken lines are the toothed coupling rack 10 and pressure spring 11, as well as its end pieces 12 and 3 and cam 14.

Figure 5:
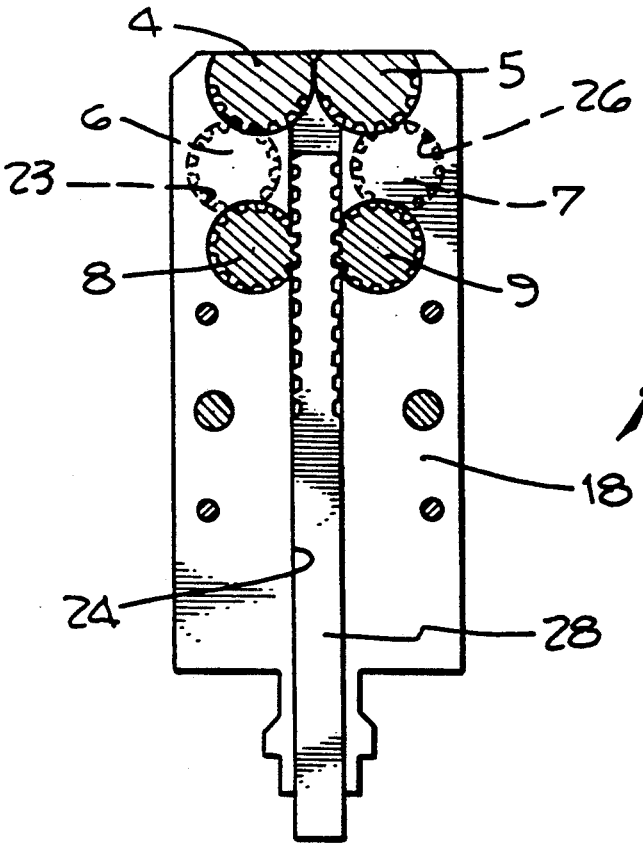
FIG. 5 is an elevation view of one of the base elements of the assembled die device shown in FIG. 4.

Base elements 18 and 19 are identical in design. However, the openings 24 and 25 for receiving the toothed coupling rack, in the base elements 18 and 19, respectively, are not arranged midway of their length. Rather, in each case, they are located at the outer surface of base elements 18 and 19. FIG. 5 shows an elevation view of the corresponding end of base element 18. In the assembled die device of FIG. 4, the base elements 18 and 19 are set in different orientation, with the ends, toward which the toothed coupling rack openings 24 and 25 are open, directed facing each other. Also, openings for two cogged disks are provided in each of base elements 18 and 19. These openings are represented by broken lines and marked as 26 and 27. The base elements 18 and 19 do not have an integrated spring mechanism. Rather, the toothed coupling rack 28, in each of base elements 18 and 19, is designed to extend downward beyond their base parts. An external spring mechanism (not shown) may be engaged, in any desired way, on this projection of the toothed coupling rack 28.

Figure 6:
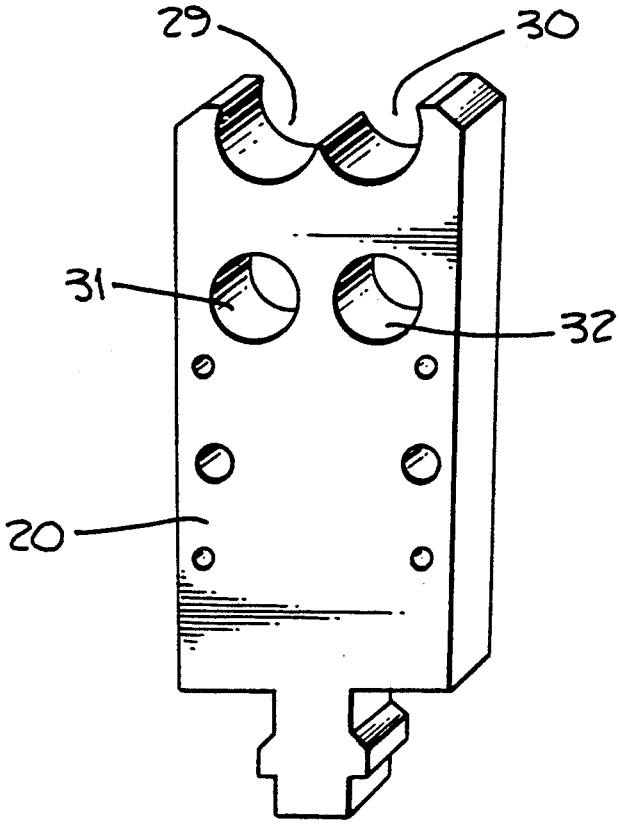
FIG. 6 is a perspective view of an intermediate or extension piece of the die device shown in FIG. 4.

FIG. 6 shows, in perspective, the extension element 20. As in extension element 21, extension element 20 has only those openings 29–32 which are necessary, two openings 29 and 30 for the die bars 4 and 5, and two openings 31 and 32 for the cogwheel shafts 8 and 9. Extension elements 20 and 21 are not, as are base elements 17, 18 and 19, described above, designed to receive cogged disks, toothed coupling racks and/or springs.

The length of the die bars and cogwheel racks to be set into the assembled body elements described above is so dimensioned that they extend over the entire length in one piece, or in several partial pieces secured together by suitable means. Finally, the individual base and extension elements may be secured together by suitable means, for example by threaded rods passing through them. Naturally, the base elements and extension elements may be combined with each other in practically any desired numbers or ways. In the two adjoining toothed coupling rack openings 24 and 25 in base elements 18 and 19, respectively, two racks or a single rack of double width may be used.

Figure 7:
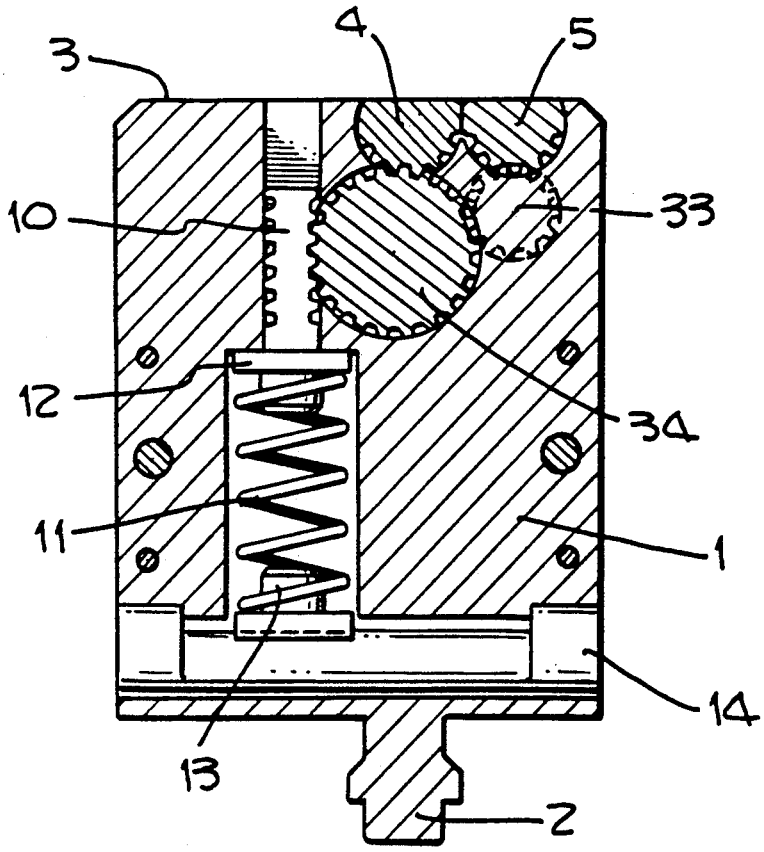
FIG. 7 is a detailed section view of another embodiment of a die device according to the invention.

The forced-coupling of the two die bars 4 and 5 may, of course, be accomplished in ways other than those described above. For example, particularly as shown in FIG. 7. In FIG. 7, the two die bars 4 and 5 are engaged directly, without the interposition of two cogged disks, by cogwheel shafts 34 and 33, respectively, which are also, in each case, engaged with each other. The cogwheel shafts 33 and 34 have different diameters so that it is possible for the toothed coupling rack 10 to be engaged with cogwheel shaft 34 without, at the same time, being engaged with die bar 4. Of course, with a different arrangement of the toothed coupling rack, and/or with the omission of the spring effect, the diameters of the two cogwheel shafts 33 and 34 may be the same.

Moreover, the force or moment of rotation effected by the pressure spring 11 may also be realized by other means, for example, hydraulically or pneumatically. In addition, there are other means of transmission of said effect to the die bars 4 and 5. Finally, in the die devices and base elements discussed above according to FIGS. 1, 2, 3 or 7, the toothed coupling rack may be arranged flush against one end of the device or base element, rather than in the middle.

I claim:

1. A die device for use in bending metal stock having:

a body with a flat upper surface;

a pair of die bars in direct meshing engagement supported rotatably around their lengthwise axis having substantially flat upper surface and substantially cylindrical undersurfaces and being arranged contiguously, side-by-side in a lengthwise direction; and coupling means by which each die bar, of the pair of die bars, is engaged with the other die bar to effect a desired force-coupling such that each die bar rotates in a direction opposite that of the other die bar, a number of teeth being formed in the cylindrical undersurfaces of each die bar, said teeth being contained only in a predetermined angle of the cylindrical undersurface of each die bar, said angle corresponding to a maximum desired angle of rotation of each die bar during a bending process, said coupling means further including said die bars being engaged with each other by cogwheel means adapted to rotate said die bars, which effect the desired force-coupling.

2. A die device for use in bending metal stock having:

a body with a flat upper surface;

a pair of die bars in direct meshing engagement supported rotatably around their lengthwise axis having substantially flat upper surfaces and substantially cylindrical undersurfaces and being arranged contiguously, side-by-side in a lengthwise direction; and coupling means by which each die bar, of the pair of die bars, is engaged with the other die bar to effect a desired force-coupling such that each die bar rotates in a direction opposite that of the other die bar, a number of teeth being formed in the cylindrical undersurfaces of each die bar, said teeth being contained only in a predetermined angle of the cylindrical undersurface of each die bar, said angle corresponding to a maximum desired angle of rotation of each die bar during a bending process, said coupling means further including the die bars being engaged with each other by cogwheel means adapted to rotate said die bars and a toothed coupling rack engaging said cogwheel means, which effect the desired force-coupling.

3. A die device in accordance with claim 2 wherein the toothed cylindrical undersurface of each die is engaged by said cogwheel means adapted to rotate each of said dies, each of said cogwheel means having a pair of cogwheels inter-engaged cogwheels.

4. A die device in accordance with claim 3 wherein the radius of each cogwheel of the cogwheel means is substantially the same.

5. A die device in accordance with claim 3 wherein one cogwheel of the cogwheel means is engaged by said toothed coupling rack.

6. A die device in accordance with claim 5 wherein the toothed coupling rack is arranged in a lengthwise direction perpendicular to the plane defined by the upper flat surfaces of the die bars.

7. A die device in accordance with claim 3 wherein means are provided to effect a moment of rotation adapted to act upon the die bars and against the moment of rotation exerted on the die bars during the bending process, such that after the bending process the die bars are returned to the position which they were in before the bending process.

8. A die device in accordance with claim 7 wherein the means employed to effect said moment of rotation is a pressure spring, which acts on said toothed coupling rack.

9. A die device for use in bending metal stock having:

a body with a flat upper surface;

a pair of die bars in direct meshing engagement supported rotatably around their lengthwise axis having substantially flat upper surfaces and substantially cylindrical undersurfaces and being arranged contiguously, side-by-side in a lengthwise direction; and coupling means by which each die bar, of the pair of die bars, is engaged with the other die bar to effect a desired force-coupling such that each die bar rotates in a direction opposite that of the other die bar, a number of teeth being formed in the undersurfaces of each of said die bars, said coupling means further including the toothed cylindrical undersurface of each die bar being engaged by a first cogwheel means having a plurality of inter-engaged cogwheels, each cogwheel in the first cogwheel means being engaged by a second cogwheel means also having a plurality of inter-engaged cogwheels, at least one cogwheel of the second cogwheel means being engaged by a toothed coupling rack.

10. A die device for use in bending metal stock having:

a body with a flat upper surface;

a pair of die bars in direct meshing engagement supported rotatably around their lengthwise axis having substantially flat upper surface and substantially cylindrical undersurfaces and being arranged contiguously, side-by-side in a lengthwise direction; and coupling means by which each die bar, of the pair of die bars, is engaged with the other die bar to effect a desired force-coupling such that each die bar rotates in a direction opposite that of the other die bar, a number of teeth being formed in the cylindrical undersurfaces of each die bar, said teeth being contained only in a predetermined angle of the cylindrical undersurface of each die bar, said angle corresponding to a maximum desired angle of rotation of each die bar during a bending process, said coupling means including the die bars being engaged with each other by cogwheel means adapted to rotate said die bars and a toothed coupling rack engaging said cogwheel means, which effect the desired force-coupling, the toothed coupling rack being arranged in a lengthwise direction perpendicular to a plane defined by the upper flat surfaces of the die bars.

11. A die device for use in bending metal stock having:

a body with a flat upper surface;

a pair of die bars in direct meshing engagement supported rotatably around their lengthwise axis having substantially flat upper surfaces and substantially cylindrical undersurfaces and being arranged contiguously, side-by-side in a lengthwise direction; and coupling means by which each die bar, of the pair of die bars, is engaged with the other die bar to effect a desired force-coupling such that each die bar rotates in a direction opposite that of the other die bar, a number of teeth being formed in the cylindrical undersurfaces of each die bar, said teeth being contained only in a predetermined angle of the cylindrical undersurface of each die bar, said angle corresponding to a maximum desired angle of rotation of each die bar during a bending process, said coupling means including the die bars being engaged with each other by cogwheel means adapted to rotate said die bars and a toothed coupling rack engaging said cogwheel means, which effect the desired force-coupling, and means provided cooperating with said rack to effect a moment of rotation adapted to act upon the die bars and against a moment of rotation exerted on the die bars during the bending process, such that after the bending process, the die bars are returned to a position which they were in before the bending process began.

12. A die device in accordance with claim 11 wherein the means employed to effect said moment of rotation consists of a pressure spring, which acts on the toothed coupling rack.

13. A die device in accordance with claim 11 wherein the die bars, the coupling means and the means required to effect the moment of rotation are contained within a body.

14. A die device for use in bending metal stock having:

a body with a flat upper surface;

a pair of die bars of substantially the same diameter supported rotatably around their lengthwise axis having substantially flat upper surfaces and substantially cylindrical undersurfaces and being arranged contiguously, side-by-side in a lengthwise direction;

coupling means by which each die bar, of the pair of die bars, is engaged with the other die bar to effect the desired force-coupling such that each die bar rotates in a direction opposite that of the other die bar whereby said coupling means causes each die bar to move synchronously and by the same angle of rotation in a direction opposite that of the other die bar, each of said die bars having a number of teeth formed in the cylindrical undersurfaces thereof, said teeth being contained only in a predetermined angle of the cylindrical undersurface of each die bar, said angle corresponding to the maximum desired angle of rotation of each die bar during the bending process; and cogwheel means adapted to rotate said die bars engaging each of said die bars for effecting the desired force-coupling.

15. A die device in accordance with claim 14 wherein a toothed coupling rack engages said cogwheel means for effecting the desired force-coupling.

16. A die device in accordance with claim 15 wherein the toothed cylindrical undersurface of each die is engaged by said cogwheel means adapted to rotate each of said dies, each of said cogwheel means having a pair of inter-engaged cogwheels.

17. A die device in accordance with claim 16 wherein the radius of each cogwheel of the cogwheel means is the same.

18. A die device in accordance with claim 16 wherein one cogwheel of the cogwheel means is engaged by said toothed coupling rack.

19. A die device in accordance with claim 18 wherein the toothed coupling rack is arranged in a lengthwise direction perpendicular to the plane defined by the upper flat surfaces of the die bars.

20. A die device in accordance with claim 16 wherein means are provided to effect a moment of rotation adapted to act upon the die bars and against the moment of rotation exerted on the die bars during the bending process, such that after the bending process the die bars are returned to the position which they were in before the bending process.

21. A die device in accordance with claim 20 wherein the means employed to effect said moment of rotation is a pressure spring, which acts on said toothed coupling rack.

* * * * *